US006427987B1

(12) United States Patent
Campling et al.

(10) Patent No.: US 6,427,987 B1
(45) Date of Patent: Aug. 6, 2002

(54) RADIALLY COMPRESSED ELASTIC ROPE

(75) Inventors: Barry Campling, Orchard House, Spaldington, Goole, Humberside, DN14 7NJ; William Kenneth Donaldson, Beverley, both of (GB)

(73) Assignee: Barry Campling, Spaldington (GB)

( * ) Notice: Subject to any disclaimer, the term of this patent is extended or adjusted under 35 U.S.C. 154(b) by 0 days.

(21) Appl. No.: 09/400,505

(22) Filed: Sep. 21, 1999

Related U.S. Application Data

(62) Division of application No. 08/578,524, filed on Apr. 2, 1996, now Pat. No. 6,000,477.

(30) Foreign Application Priority Data

Jul. 10, 1993 (GB) ..... 9314283
Jul. 13, 1993 (GB) ..... 9314424

(51) Int. Cl.[7] ..... F16F 1/00
(52) U.S. Cl. ..... 267/69
(58) Field of Search ..... 267/73, 74, 69

(56) References Cited

U.S. PATENT DOCUMENTS

| | | | | | |
|---|---|---|---|---|---|
| 4,597,351 | A | * | 7/1986 | Brainard, II | 114/230 |
| 4,640,178 | A | * | 2/1987 | Kurzbock | 87/6 |
| 4,834,290 | A | * | 5/1989 | Bailey | 5/89 |
| 4,844,661 | A | | 7/1989 | Martin et al. | |
| 4,984,639 | A | | 1/1991 | Lindsey et al. | |
| 5,056,954 | A | * | 10/1991 | Flux et al. | 403/330 |
| 5,062,085 | A | * | 10/1991 | Andrews, Jr. | 367/20 |
| 5,151,398 | A | | 9/1992 | Hsu et al. | |
| 5,248,001 | A | | 9/1993 | Moseley | |
| 5,549,285 | A | * | 8/1996 | Collins | 267/148 |
| 5,904,640 | A | * | 5/1999 | Shahinian | 482/110 |
| 6,000,477 | A | * | 12/1999 | Campling et al. | |

FOREIGN PATENT DOCUMENTS

| | | | |
|---|---|---|---|
| DE | 1510114 A | * | 1/1970 |
| DE | 3220984 A1 | * | 7/1983 |
| EP | 208616 A3 | * | 1/1987 |
| EP | 236031 A2 | * | 9/1987 |
| EP | 252863 A1 | * | 1/1988 |
| FR | 2579240 | * | 9/1986 |
| GB | 466807 | * | 6/1937 |

OTHER PUBLICATIONS

"Specification for Heavy Duty Braided Rubber Cord, BS 3F 70: 1991", BSI, 2 Park Street, London, W1A 2BS.*

* cited by examiner

*Primary Examiner*—Paul N. Dickson
*Assistant Examiner*—Xuan Lan Nguyen
(74) *Attorney, Agent, or Firm*—Jenkins & Wilson, P.A.

(57) ABSTRACT

The present invention provides apparatus for applying additional momentum to the movement of a body (1) adapted to reciprocate or flex through a substantially linear or arcuate path, notably for increasing the impact velocity of a linearly travelling weight upon an object (3), which apparatus comprises means (4) for retracting the body from its rest position, notably for retracting a weight from the point of impact between the weight and an object located at the rest position of the weight, means (5) for biassing the body towards its rest position, notably for urging the weight towards the object so as to impart additional impact velocity to the weight as it travels towards the object, characterised in that: a) the means for biassing the body towards its rest position is an elastic polymeric material which is retained under tension or compression when the body is in its rest position; and b) the biassing means is one which undergoes strain crystallisation. The invention also provides a method for breaking or penetrating a surface using the apparatus of the invention.

6 Claims, 7 Drawing Sheets

RADIALLY COMPRESSED ELASTIC ROPE

RELATED APPLICATIONS

This application is a Divisional of prior U.S. patent application Ser. No. 08/578,524 filed Apr. 2, 1996, the contents of which are incorporated herein by reference.

The present invention relates to an apparatus and method, notably to an apparatus for causing a body to move linearly in response to the energy stored in an elastomeric driver unit and to a method for causing such movement.

BACKGROUND TO THE INVENTION

Typically, pile drivers and hydraulic hammers incorporate a weight which is carried upon a guide frame for reciprocating travel. The weight is raised against gravity by an hydraulic ram to which high pressure fluid is applied to extend the ram. When the weight has been raised to the desired extent, the high pressure fluid is vented from the ram and the weight is allowed to fall under gravity upon the pile, ground compaction foot, ground breaker tool or other object upon which the weight is to act. The hydraulic ram can act directly upon the weight, for example as when the weight is attached to the piston rod of the ram and is raised as the piston within the cylinder of the hydraulic ram is raised. Alternatively, the hydraulic ram can act indirectly upon the weight, as when the weight is attached to the piston rod of the hydraulic cylinder by a rope which passes over a pulley at or adjacent the top of the guide frame or as when the hydraulic cylinder acts upon the end of a lever arm connected to the weight.

The operation of the hydraulic ram serves to raise the weight against gravity to the desired extent to achieve the desired impact blow upon the object being acted upon when the ram is allowed to contract. The object can be, for example the top of a pile which is to be driven into the ground, a ground compaction foot which is used to compact or level the ground, or an earth or concrete breaker tool which it is desired to subject to a linearly acting impact blow.

For convenience the term hydraulic hammer will be used herein to denote apparatus of the above type in general in which an object is subjected to a linearly acting impulse blow by a weight which is reciprocated by means of an hydraulic ram.

The size of the impact blow will depend upon the mass of the weight and the velocity of the weight at the moment of impact with the object being struck. With a weight which is raised against gravity by a single acting hydraulic ram and falls under gravity, the velocity will depend upon the height to which the weight is raised. Practical considerations may limit the mass which can be raised by a given hydraulic ram and the height to which the apparatus can extend.

It has therefore been proposed to use a double acting ram in which the weight is raised by one part of the cycle of operation of the ram (the rising stroke of the ram) and then positively driven in the opposite direction by a second part of the cycle of the ram operation (the falling stroke of the ram). Whilst such double acting rams may achieve a greater impact blow due to the positive drive imparted to the weight by the ram during the falling stroke of the ram, the need to regulate the flow of hydraulic fluid to and from the ram introduces complexity in the fluid control system and requires the use of high and low pressure accumulators to enable the high flow rates of high and low pressure to and from the ram cylinder to ensure an adequate rate of motion of the weight on its upward and downward travel and to enable a rapid rate of repetition of the impact blows to be achieved.

The energy available at impact of the weight upon the object is dependent upon the velocity which the weight attains at impact. Typically, in a hammer as used in a rock breaker or drill, the weight which is being driven by the double acting ram is comparatively light, often no more than the weight of the object against which it is being driven. In order for such a light weight to acquire a high energy in a short distance of travel, the weight must be subjected to high acceleration by the ram. This also results in a short time for the ram to complete its stroke. As a result, particularly in such applications of an hydraulic ram, it is necessary to ensure that fluid is fed to the ram at high pressures to achieve the necessary acceleration and that the rate of flow of fluid to and from the ram is high to allow the ram piston to move rapidly within the ram cylinder. This requires the use of large and powerful fluid pumping systems and the use of high and low pressure accumulators to achieve the desired flow rates of high and low pressure fluids to and from the cylinder of the ram. These components have added to the weight, size and complexity of the hammer assembly, over and above the hydraulic ram and the weight. Where the hammer is to be transportable, it is necessary to provide support machines, for example cranes or tractors to support and carry the hammer mechanism over the ground at sites where the hammer is used, for example to achieve some form of work on or in the ground, for example soil compaction, pile driving, rock drilling or concrete slab break up. The need for large support machines adds to the cost and complexity of the equipment.

In place of a double acting ram, it has been proposed to lift the weight against a coil compression spring using a single acting hydraulic ram, so that the spring provides a positive downward force when the lifting of the weight by the ram has been completed and the weight is released for downward travel. Such a spring has to be large and heavy to provide the necessary downward force to be practicable and provides little benefit over the use of a conventional single acting ram powered mechanism which achieves the same impact blow with the same weight.

We have now devised a mechanism by which a single acting hammer mechanism can readily be provided with additional energy storage means to provide the driving force on the falling stroke of the hydraulic ram and thus enhance the velocity of the weight upon impact with the object which it is to strike. The invention thus provides an alternative to the use of a double acting hydraulic ram, notably in applications such as rock or concrete drills or breakers, using a single acting hydraulic ram. The invention reduces the need for and/or the size and weight of any high and/or low pressure hydraulic accumulators which may be required as compared to a double acting ram and enables a lighter and simpler overall hammer mechanism to be achieved, thus reducing the required size and weight of the support machine whilst achieving an impact blow significantly greater than that achieved using a single acting ram raising the weight to the same height.

The invention can also be applied to testing of rigid structures in which the structure is deflected by an applied deflection force from its rest position against a biassing load force, is released at a predetermined degree of deflection, and is allowed to flex repeatedly under the biassing force and the opposing forces due to the rigidity of the structure and/or due to the cyclically applied opposed deflection forces. For example, the invention can be applied to the fatigue testing of elongated structures, such as aircraft wings, which are subjected to cyclically varying deflection forces whilst being subjected to a continuous biassing force.

SUMMARY OF THE INVENTION

Accordingly, the present invention provides apparatus for applying additional momentum to the movement of a body adapted to reciprocate or flex through a substantially linear or arcuate path, notably for increasing the impact velocity of a linearly travelling weight upon an object, which apparatus comprises means for retracting the body from its rest position, notably for retracting a weight from the point of impact between the weight and an object located at the rest position of the weight, means for biassing the body towards its rest position, notably for urging the weight towards the object so as to impart additional impact velocity to the weight as it travels towards the object, characterised in that:

a. the means for biassing the body towards its rest position is an elastic polymeric material which is retained under tension or compression when the body is in its rest position; and b. the biassing means is one which undergoes strain crystallisation.

The invention also provides a method for breaking up or penetrating a surface by applying impact blows to a tool in contact with the surface, characterised in that impact blows are applied by an apparatus of the invention.

The term rest position is used herein to denote that position which the weight or structure adopts during operation of the apparatus in the absence of the retracting force. In the case of a structure which is being flexed under the influence of the retracting and biassing forces, the rest position will be that position adopted by the structure in the absence of the retracting force but the biassing force may or may not continue to be applied. Thus, the biassing force may simulate a constant load which is applied to the structure, for example the lifting force of an aircraft wing during normal flight, and the retracting force simulates abnormal loading of the wing, as may occur during turbulence. In this case, the wing will be subjected to a continuous biassing force which will cause the wing to adopt an upwardly flexed configuration which is the rest position about which the wing flexes. In other cases, the biassing force may represent some other load imposed upon the wing which is not normally present, in which case the rest position would be that position adopted by the wing in the absence of both the retracting and biassing forces. In the case of a falling weight of a hammer, the rest position is the position of impact between the weight and the object which it is to strike, in which case the weight may still be subject to some residual biassing force. However, it will be appreciated that the weight may travel beyond the point of impact, for example during over-run of the travel of the weight or when the hammer operation is completed and the weight is allowed to fall to its lowest or out of operation point at which the residual biassing force may be negligible. This over-run extreme of travel or out of operation point will usually be located axially beyond the rest position at which the weight would impact upon the object and is not considered to be the rest position for the purposes of the present invention.

The retracting force is generated by any suitable means, for example a cam and follower type mechanism where the movement required of the body is small, as may be the case with a fatigue test. However, it will usually be desired to retract the body a distance of tens of centimeters from its rest position and it will therefore be preferred to generate the retracting force by means of an hydraulic ram or rams. For convenience, the invention will be described hereinafter in terms of the use of a single hydraulic ram of conventional design and operation to generate the retracting force applied to the body. It will be appreciated that more than one such ram may be used, or example a pair of rams may be located alongside diametrically opposed sides of the weight and the free ends of the piston rods of the rams connected by a transverse yoke member which carries the weight suspended therefrom.

The body upon which the ram acts can be a rigid structure, such as an aircraft wing or other component, which is to be subjected to repeated flexing, in which case a number of rams and biassing force means can be located along the length of the structure to impart retraction and biassing forces uniformly distributed along its length. However, as indicated above, the invention is of especial application where the body is a weight which is to apply an impact blow to an object, for example a hammer head in a drop forger, a pile cap, the ground or to a ground or other solid breaking tool, for example a concrete breaker chisel tool.

The weight can travel along a path aligned at any angle to the horizontal or vertical according to the use to which the apparatus incorporating the weight is to be put. Thus, in a rock drill or breaker, the weight can travel upwards co deliver its impact blow at the end of its upward travel. In a fatigue test application, the biassing force may act horizontally or vertically. However, the invention is of especial application in apparatus in which the weight travels generally up and down and imparts its impact blow at the end of its downward travel. For convenience, the invention will be described hereinafter in terms of a weight which is to be repeatedly lifted and dropped upon an object which is to be subjected to repeated impact blows.

The weight is preferably guided along a substantially linear path by means of a guide frame, rail or track within or upon which the weight is slideably carried. Such guide frames, rails or tracks can be of conventional design and construction. If desired, the weight can be mounted in or upon the guide frame, rail or track by means of an interface which incorporates one or more rotating members, for example rollers or wheels. The interface can be in the form of one or more discrete carriage units each incorporating a wheel or roller, or can be provided by a support frame carrying exposed rotating surfaces along its length, for example a chain carrying ball bearings rotatable located in successive links. It is preferred to use two or more roller or wheel type carriage means carried by the weight or its support. The use of such a rotating interface means does away with the lubrication hitherto considered essential where slider type carriage means were used. Furthermore, such interface means can be subjected to lateral forces whilst maintaining their free running properties. It thus becomes possible to apply the retracting and biassing forces off-centre to the line of travel of the weight without the interface means imposing excessive resistance to the movement of the weight. Preferably, the weight or its support is provided with two of more such carriage means axially displaced from one another along the line of travel of the weight, whereby any tendency of the weight to twist out of alignment with its line of travel during it movement is reduced. Typically, the carriage means will be provided at or adjacent each axial end portion of the weight or its support.

The use of such axially displaced carriage means or axially extending interface means enables the retracting and biassing forces to be applied to the weight off-centre from the line of travel of the weight, for example to apply the retracting force lifting the weight by means of a ram off set to one side of the line of travel of the weight and connected to the weight by means of a transverse connecting arm or yoke carried by the weight. The ability to apply the forces off-centre from the line of travel of the weight enables the hydraulic ram to be located alongside the weight and not in line therewith, thus reducing the overall height of the ram and weight. Such a construction is of especial benefit in the construction of a rock, concrete or similar machine where a working tool is to be impacted upon, break up or penetrate a surface where the weight which is to be reciprocated rapidly and off line forces may often be generated.

Accordingly, from another aspect, the present invention also provides a mechanism in which a weight is to be reciprocated along a substantially linear line of travel to impact upon a tool whose operative end is to impact upon, break up or penetrate a surface, characterised in that the weight or a support member operatively associated with the weight is carried by means of one or more rotating interface means, notably ball bearings, rollers or wheels, upon a guide member which is adapted to guide the travel of the weight during its reciprocation.

As indicated above, the weight is preferably lifted by the hydraulic ram and allowed to fall under gravity and the biassing force. The hammer assembly is therefore designed and constructed about a generally vertical line of travel of the weight. However, the weight can travel along any other suitable line of travel, for example a horizontal line of travel or at any other inclination between the horizontal or vertical. If required, the support machine for the hammer mechanism can be provided with means for varying the line of travel of the weight, for example by independently operable rams to adjust the fore and aft and side to side inclination of the guide rails or other supports upon the which the weight travels.

The hydraulic ram is operated by the application and release of high pressure fluid to the cylinder of the ram which extends or retracts a piston rod extending from the piston within the cylinder of the ram. The means for generating the high pressure fluid, controlling its flow to and from the cylinder and any accumulators required to accommodate the flow of fluid can be of conventional design and construction. The operation of the hydraulic ram is preferably controlled by sensors which detect the upper and lower extremes of the travel of the weight and control the operation of the valve mechanisms controlling the flow of high pressure fluid into and out of the cylinder of the ram. Such control sensors can be of conventional design and operation. Preferably, the hammer assembly incorporates means whereby the weight can travel beyond its rest position, for example when the chisel tool is accidentally removed from the equipment so that the weight does not impact upon an object at the end of its travel or if the operative tip of the chisel tool is not in contact with the ground or the concrete or stone to be broken up. Typically, such excess travel or over-run is provided with energy absorbing means whereby the impact energy of the weight is at least in part absorbed or dissipated before the end of the over-run of the weight is reached. For example, the over-run can be against friction pads, rubber stops, hydraulic accumulators, or other elastic, viscous or visco-elastic means. Preferably, sensor means are incorporated in the hammer assembly to detect when over-run occurs, notably to de-active further operation of the hammer and to provide an audible and/or visual alarm to an operator.

The means for generating the biassing force for driving the weight downwardly upon the object when the ram reaches the extreme of its lifting stroke comprises an elastic polymeric material which acts under compression and/or tension to score energy as the weight is retracted from the object by the hydraulic ram. The elastomeric polymer can be formed into any suitable shape to suit the configuration of the hammer assembly into which it is to be incorporated. For example, the polymeric material can be moulded, extruded or cast as an axially elongated solid rod, bar or strip of material, notably one having radially enlarged terminal portions to form the means by which the lengths of material can be secured to the moving weight and a static part of the hammer assembly. However, it is preferred to form a plurality of substantially linear strands of the polymer into a rope or similar body which is tensioned as the weight is raised. Typically, such a rope will comprise a plurality of linear untwisted individual strands of a suitable polymer or a mixture of strands of different polymers. If desired, the rope formed from the individual strands can be sheathed in a sleeve to form a coherent structure to the rope and to reduce damage to the strands due to abrasion and/or contact with hydraulic fluids or the like. For convenience hereinafter the term internal structure of the rope will be used to denote the strands of polymer within the protective sheath and the term rope will be used to denote the overall construction of the strands and the protective sheath. Preferably, such sheath is in the form of a braided relatively inextensible textile yarn which is applied, for example by means of a conventional braiding machine, to form a close fitting sheath upon the internal structure of the rope whilst the internal structure of the rope is held in an extended condition. Typically, this extension is from 40 to 200% of the untensioned state of the rubber strands before they enter the braiding process. Upon relaxation of the tension on the internal structure of the rope, the close fit of the sheath upon the internal structure of the rope preferably prevents total retraction of the internal structure of the rope within the sheath. Typically, the internal structure of the rope is held by the protective sheath in an extension of from 25 to 150%, notably from 40 to 100%, beyond its untensioned length. Typically, such ropes are made according to British Standards (Aerospace Series) Specification No BS 3F70:1991 and are commercially available for use, for example, in the arrester mechanism for aircraft on aircraft carrier landing decks. For convenience, the invention will be described hereinafter in terms of the use of a rope made from a plurality of strands of a polymeric material.

Preferably, the polymers for present use are those which exhibit strain crystallisation under tension, since we have found that such polymers provide prolonged life during use. Typical of such polymers are natural and synthetic rubbers, notably polyisoprene, polychloroprene and poly(cis) isoprene rubbers; butadiene and styrene-butadiene rubbers; polyurethene rubbers; polyalkylene rubbers, for example isobutylene, ethylene or polypropylene rubbers; polysulphone, polyacrylate, perfluoro rubbers; and halogenated derivatives and alloys or blends of such rubbers. The use of natural rubber, chloroprene or synthetic isoprene rubbers is especially preferred. For convenience, the invention will be described hereinafter in terms of the use of a plurality of strands of a natural rubber to form the internal structure for the rope.

The rope can be of any suitable size, cross-section and length having regard to the impact velocity of the weight which it is desired to achieve. However, we have found that it is desirable to preserve the internal structure of the rope under tension at all times, notably when the weight is in its rest position, so that the individual strands within the internal structure of the rope are held under tension at all times and are thus retained under strain crystallisation at all times. As indicated above, at least part of this extension is due to the close fit of the sheath upon the internal structure of the rope. However, it is preferred to locate the mountings for the rope upon the hammer assembly so that the weight in its rest position imparts at least 15% further extension to the rope, this further extension being over and above the extension imparted in its sheathed state as manufactured as described above. However, it is preferred that the maximum upward travel of the weight should not extend the rope by more than 95% of its length in the sheathed state as manufactured. It is also preferred that the extra travel of the weight which may occur during any over-run as described above does not allow the rope to return to the unextended state of its sheathed form.

The rope can be secured to the weight, the yoke carrying the weight or any other suitable part of the hammer assembly which travels with the weight; and to any part of the hammer assembly which does not travel with the weight as it falls to provided the static anchorage point for the rope. The rope can be secured using any suitable securing means. Where the rope is formed as a solid bar or rod of the polymeric material, the securing means can be formed integrally with the rod or bar as an enlarged end to the rod or bar during the moulding, extrusion or other process for forming the rod or bar from the polymeric material so that the bar or rod has a generally dumbbell configuration. Where the biassing force is generated by a rope comprising a plurality of thin strands, it may not be practicable to form the securing means in this manner and we have devised a particularly compact and effective means as described below for securing the ends of the strands of the rope in position n a terminal bobbin unit which resists detachment during the repeated tensioning and slackening of the rope. The bobbin unit is located in a suitable recess or cup carried at the anchorage positions on the weight and the hammer assembly with the rode in a tensioned state when the weight is in its rest position as described above.

In the preferred securing means, the free ends of the strands of polymer forming the internal structure of the rope are captured by means of an adhesive or cement in a metal or other rigid end cap which forms the terminal bobbin unit on the rope. We have found that the adhesive or cement can be caused to penetrate the interstices between the individual strands so as to form a bond between the strands and the end cap. If desired, the strands can be subjected to a pretreatment, notably in the case of natural or synthetic isoprene or chloroprene rubbers, to enhance the adhesion of the adhesive or cement to the strands. However, the conventional pre-treatment of vulcanised rubber surfaces with sulphuric acid is not practicable. We prefer to treat the exposed surfaces of the rubber strands with a moisture-cured cyanoacrylate adhesive and to apply the treated strands to an epoxy resin layer on the end cap. We have found that during the curing of the epoxy resin it forms a secure bond with the cyanoacrylate resin on the strands to achieve a satisfactory bond between the strands and the end cap which is capable of resisting repeated extension and contraction of the rope during use.

The end cap can be merely a transverse plate to which the ends of the strands are secured and which provides a transverse member which seats in the anchorage points on the hammer assembly. In some cases, notably with ropes of small external diameter, the end cap can be provided by an excess of the adhesive or cement which forms a solid body with the strands at the end of the rope, which solid body can act as the bobbin unit. However, it is preferred to form the end cap in the form of a cup into which the free ends of the strands are inserted and secured by the adhesive or cement.

Such a means for securing the ends of the strands of the internal structure of the rope provides adequate security for many applications. However, in order to minimise the risk of separation of the strands from the end cap, it is preferred to provide a secondary securing means immediately adjacent the end cap which also is secured to the strands and co-operates with the end cap to provide protection of the end cap from at least part of any tension applied to the rope. Preferably, such secondary securing means comprises a sleeve member which secured to the strands of the internal structure of the rope and provides a member against which the end cap member can seat to provide a closed bobbin unit. It is preferred that the sleeve grips the strands frictionally over at least part of its length, for example by being crimped or otherwise formed with a reduced diameter portion which compresses the stands within it. The secondary securing means absorbs at least part of any tension applied to the rope and reduces the stresses applied to the adhesive or cement bond between the strands and the end cap.

Typically, the sleeve is secured to the strands by reducing its internal diameter over at least part of its length. As the strands are extended, their external diameter reduces and the reduced diameter portion is sized to ensure that it radially grips the strands frictionally at the maximum extension of the rope expected during use.

Typically, the external diameter of the rope will reduce to about 20 to 45% of its untensioned diameter, i.e., by about 55 to 80% of its untensioned diameter. The reduced diameter portion of the sleeve therefore preferably has an internal diameter which is from 15 to 40% of the diameter of the rope in its sheathed but otherwise untensioned state. Preferably, the reduced diameter portion of the sleeve has an axial length which is from 0.5 to 3 times the internal diameter of the sleeve over this portion of its length. Preferably, the reduction in diameter occurs progressively, for example as a tapered convergence and divergence of the ends of the sleeve, and not stepwise, so as to reduce any risk of cutting the external sheath or the internal strands of the rope.

In an alternative method of manufacture of the bobbin ends, the strands of the rope are extended before the sleeve is applied so as to reduce their external diameter to the desired extent. The sleeve is then applied to the extended strands, for example by crimping a split sleeve around the extended strands or by binding a cord, wire or strip around the strands to form the sleeve in situ, and the strands released to contract axially and expand radially against the restraint of the sleeve. In this case, the sleeve need not have a reduced diameter portion and applies a radial compressive force to the said strands due to the radial expansion of the strands whereby the strands are secured within said sleeve by frictional forces.

If desired, the sleeve can be formed with a waisted portion from which the free ends of the strands protrude to form a diverging splayed portion. This portion is located within the end cap carrying the cement to bond the ends of the strands to the interior of the cap. The radial rim of the cap or an axially extending annular skirt at the rim of the cap engages the rim of the sleeve in a push or other fit. The free end of the sleeve can be formed with an internal flare, for example having an included cone angle of from 120 to 60°, so that the free ends of the strands splay out to follow the flare of the sleeve. The end cap can carry can carry or be formed with a conical member which extends axially into the splayed portion of the strands. In the event of axial movement of the strands within the sleeve, this conical member will be drawn with the strands into the flared portion of the sleeve and will exert an additional radial clamping action to trap the strands between the outer face of the conical member and the internal face of the sleeve.

Accordingly, from another aspect, the invention provides an extensible length of material formed from a polymeric material, preferably in the form of a plurality of strands of a natural or synthetic elastic polymeric material, notably one which undergoes strain crystallisation, having means for securing the length of material to an article, said securing means being located at or adjacent a free end of the length of material, characterised in that the securing means comprises an end cap secured to the said polymeric material by adhesive, notably an epoxy resin and the strands are subjected to a treatment with a cyanoacrylate resin.

Preferably, the securing means incorporates a sleeve member adapted to co-operate with the said end cap and to reduce the tension applied to said end cap by said strands, said sleeve member applying a radial compressive force to the said strands whereby the strands are secured within said sleeve by frictional forces.

Preferably, substantially the whole length of the strands of polymeric material are enclosed in a protective sheath or braid which applies radial compression to the said strands whereby the strands are extended between said securing means by from 25 to 150% of their uncompressed and untensioned state.

The elongated material of the invention is of especial use in providing the biassing force in the apparatus of the invention. However, the material can find a wide range of other uses where it is desired to store energy in an extended elastic member which requires to be secured terminally, for example as a counter balance mechanism for an up-and-over door mechanism or a lowering and raising ramp.

Apart from the provision of the biassing means to increase the impact velocity of the weight, the design of the hydraulic hammer can be similar to that of a conventional hammer. For example, the ram can be supplied with high pressure hydraulic fluid from a conventional pump, typically via a high pressure accumulator for a large ram as used on a pile driver, to ensure rapid flow of fluid to the cylinder of the ram on the lifting stroke. Suitable sizing of fluid ports and inflow and outflow lines will optimise the flow of fluid into and out of the cylinder of the ram to achieve the desired rate of reciprocation of the weight, ie. the strike rate of the hammer. The length and diameter of the extensible rope used to provide the biassing force will depend upon the axial length of travel of the weight and the impact velocity required. We have found that the hammer assembly of the invention typically achieves an impact velocity which is up to 250% greater than that which can be achieved using a conventional single acting hydraulic ram operating at the same energy input from the hydraulic fluid and for the same length of travel of the weight.

With a conventional double acting hammer in which the piston of the ram also acts as the weight which provides the kinetic energy for the impact blow applied at the end of the ram stroke, the piston is comparatively lightweight and must be accelerated to a considerable velocity to generate a useful impact blow. The apparatus of the invention enables the equipment designer to incorporate a heavier weight so as to generate the desired kinetic energy and to use a slower acting ram. we have found that a greater impact blow applied at a lower frequency causes greater break up or penetration of many surfaces than a smaller impact blow applied at higher frequency and it is not necessary to compensate for the slower rate of operation of the apparatus of the invention.

As a result, the apparatus of the invention can be lighter and more compact than a conventional single acting hammer assembly achieving the same impact blow; and, as compared to the forms of double acting hammers currently used on breakers utilising the weight of the piston to generate the impact blow, the apparatus of the invention operates at a more economical blow frequency, thus avoiding the need for the ancillary equipment which a high rate of frequency requires. As a result, the apparatus of the invention can be mounted on a smaller tractor or other support machine. We have also found that the noise emissions from the apparatus of the invention are reduced as compared with a conventional double acting hammer assembly achieving a similar impact blow for the implement weight.

BRIEF DESCRIPTION OF THE DRAWINGS

The apparatus of the invention will now be described by way of illustration with respect to preferred forms of the apparatus as shown diagrammatically in the accompanying drawings in which.

DESCRIPTION OF THE PREFERRED EMBODIMENTS

Figure 1:
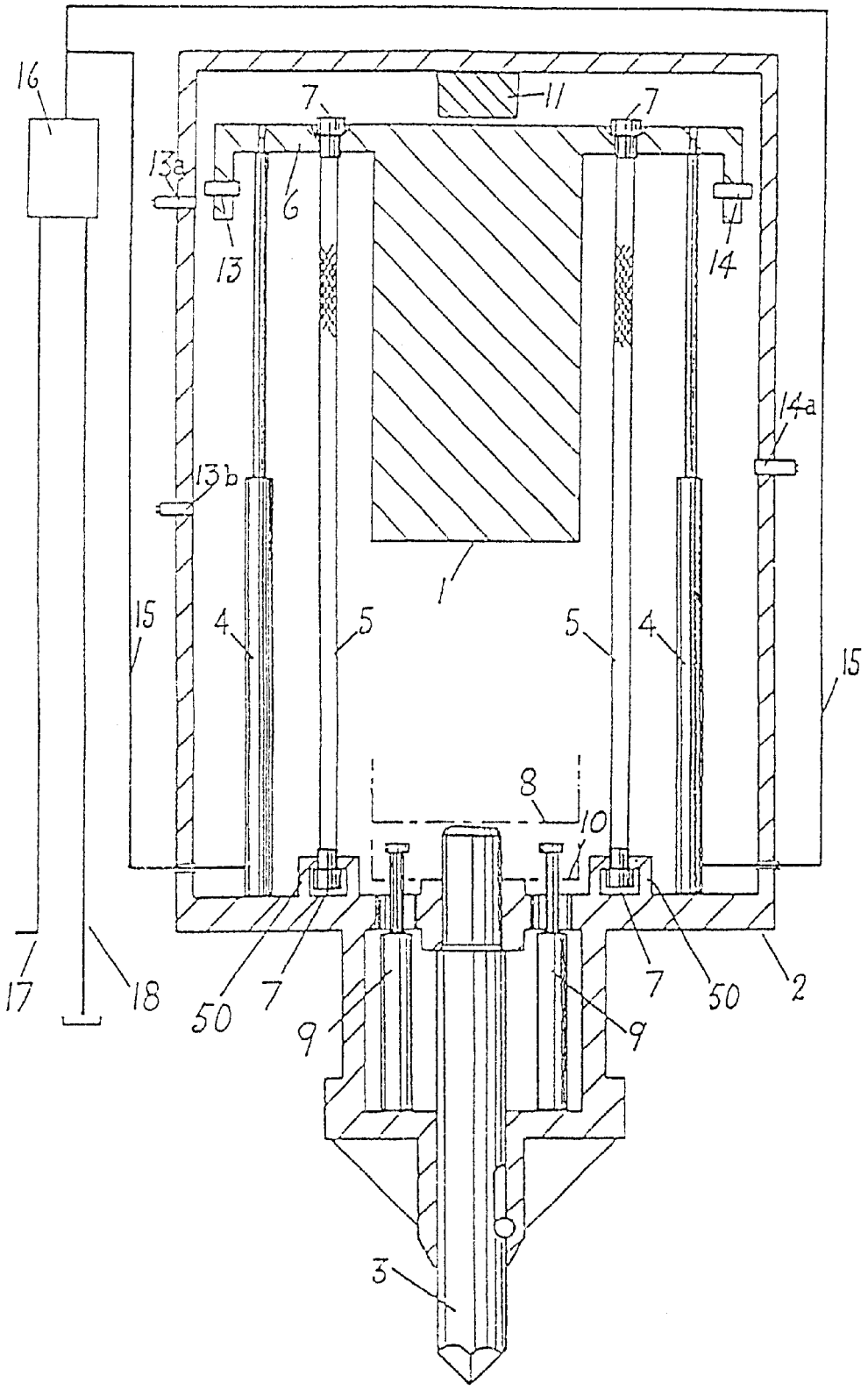
FIG. 1 is a vertical section through the hydraulic ram assembly of a powered hammer suitable for concrete breaking incorporating an elastic rope to provide the biassing force of the invention.
Figure 3:
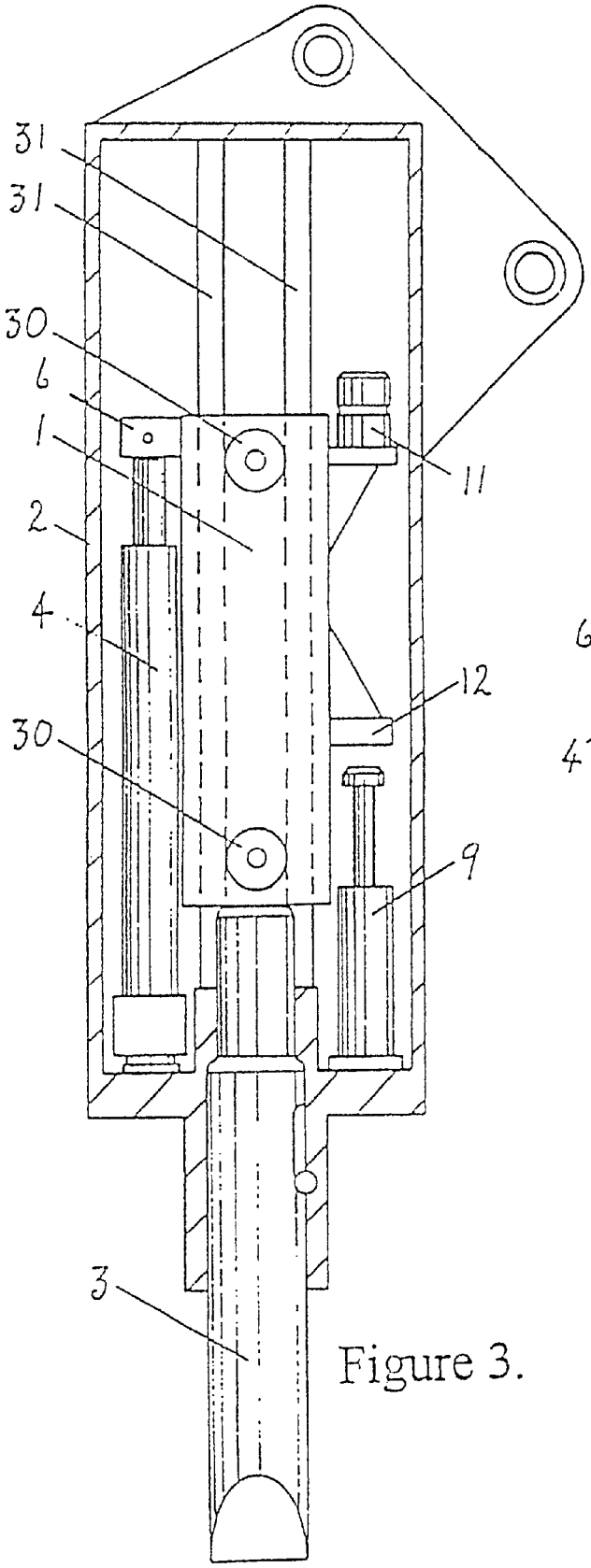
FIG. 3 is a part vertical sectional view of the weight guide assembly for use in the apparatus of FIG. 1.
Figure 4:
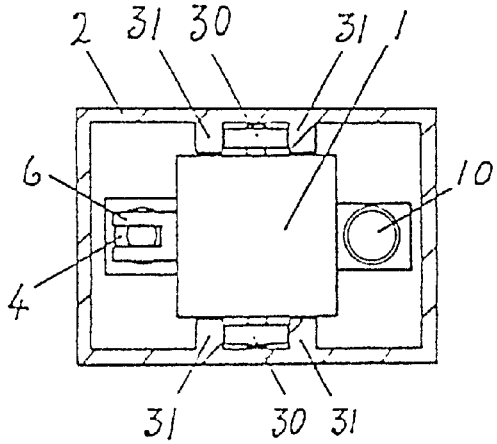
FIG. 4 is a horizontal cross-sectional view of the guide assembly of FIG. 3.
Figure 5:
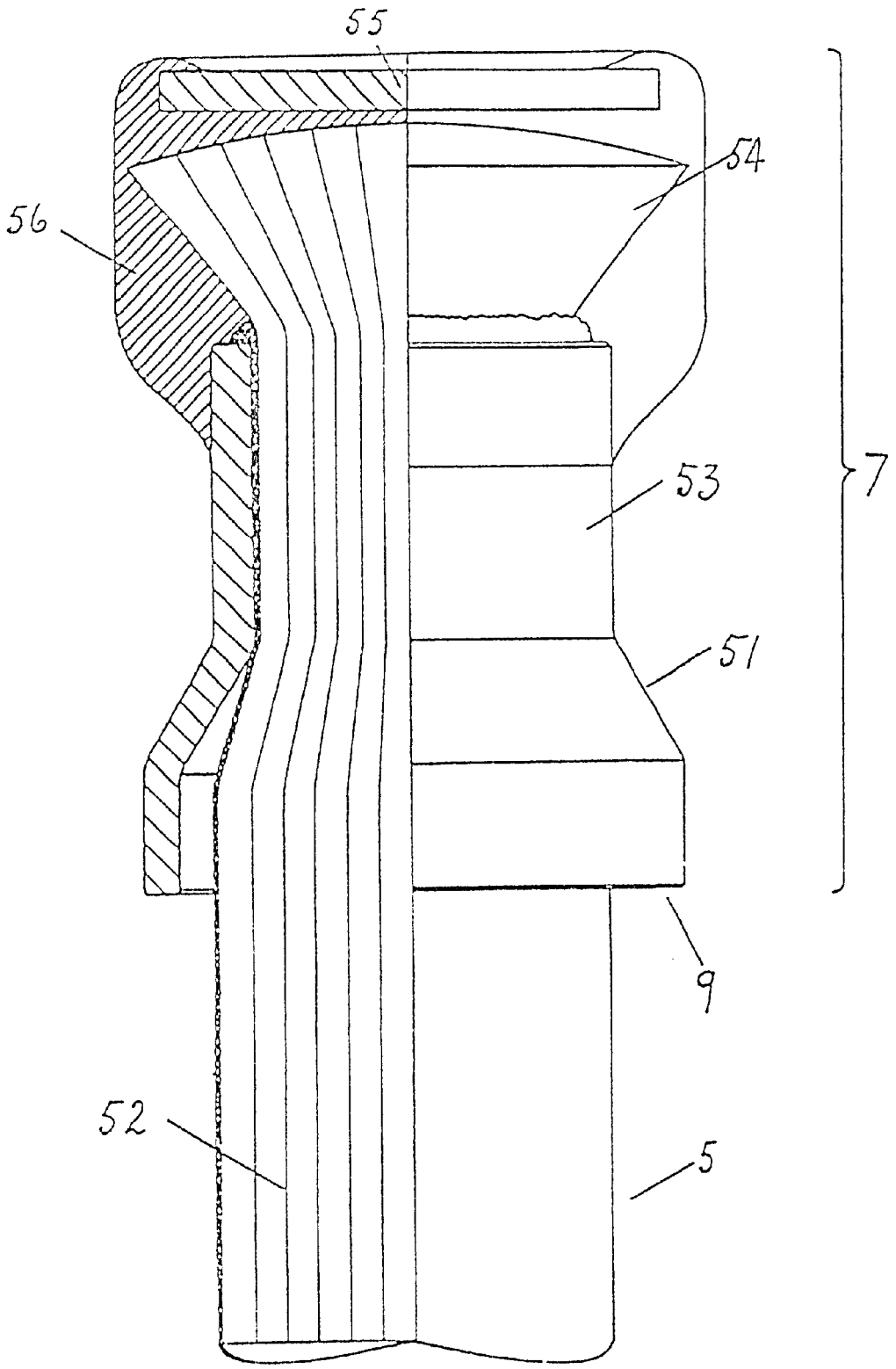
FIG. 5 is an axial cross-sectional view of the terminal bobbin unit at one end of the elastic rope used in the apparatus of FIG. 1.

In the apparatus of FIG. 1 a weight 1 is movable along guideways, shown in greater detail in FIGS. 3 and 4 described below, which are incorporated in a casing 2, to strike a tool 3 at the foot of its travel. The casing is provided with mounting points for mounting on the arm of an excavator as shown in FIG. 7. The weight 1 is moved upwardly by two hydraulic rams 4 which provide the retracting force against the tension in two elastic ropes 5 which provide the biassing force. The upper ends of the piston rods of the rams and of the ropes are connected to the weight by means of a transverse yoke 6 which permits the rams and ropes to be aligned alongside the line of travel of the weight. The weight 1 falls under the influence of gravity and the tension in the ropes 5 to strike a chisel tool 3 which bears upon rock, concrete or another surface which it is desired to break up or penetrate under the influence of the impact blow delivered by the weight 1 on tool 3. The flow of hydraulic fluid to and from the cylinders of rams 4 is controlled by hydraulic valves and electrical control circuits described in FIG. 6. The terminal bobbins 7 by which the elastic ropes 5 are anchored to yoke 6 1 and casing 2 are shown in FIG. 5.

The upper end of weight 1 is attached to a transverse yoke 6 to which are attached the rams 4 and the ropes 5 symmetrically located about the longitudinal axis of the weight. As shown in FIG. 3, the up and down travel of weight 1 is guided by means of wheels 30 carried between vertical tracks 31 in the casing 2. The wheels 30 are mounted by means of suitable stub axles extending laterally from the upper and lower portions of the weight so as to prevent twisting of the weight with respect to the tracks 31. As a result, the hydraulic ram (only one is shown in FIGS. 3 and 4 for clarity) can be mounted off the line of travel of the weight and apply its lifting force via the yoke 6 which extends laterally from the weight as shown in FIG. 1. The elastic ropes 5 can also be located off the line of travel of the weight as shown in FIG. 1.

Figure 2:
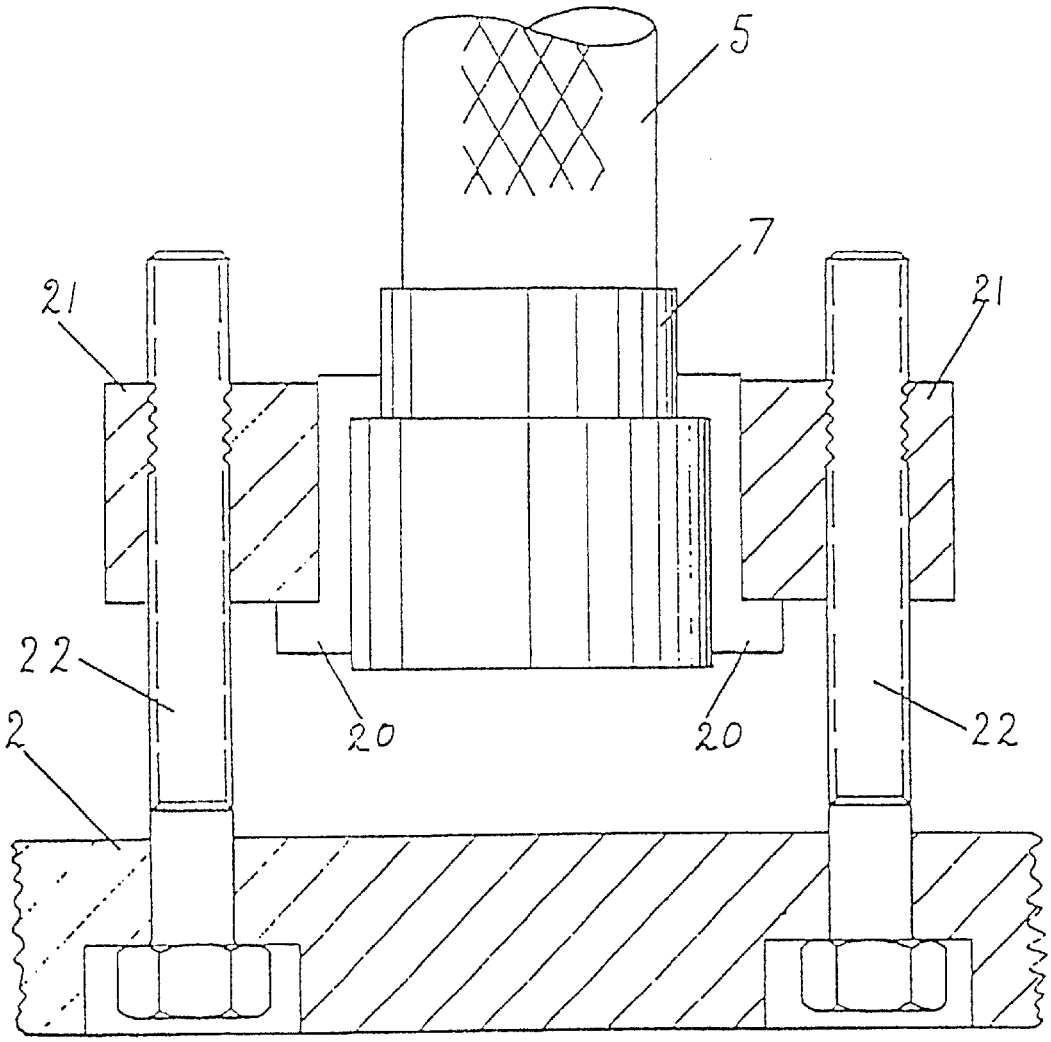
FIG. 2 is a detailed view of the means for extending the elastic rope during installation in the apparatus of FIG. 1.

The terminal bobbin units 7 carried by the elastic ropes 5 are secured to anchorage cups or recesses 50 in the casing 2 and yoke 6, as shown in FIG. 1 in a tensioned state. As shown in FIG. 2, the bobbin unit 7 at the foot of the elastic ropes can be secured by means which allow the tension in the rope 5 to be adjusted. These means comprise, for example, a cup formed by two inter-engaging split collets 20 carried in a recess in a transverse mounting arm 21. The collets can be stepped or axially tapered so that they seat firmly home in the recesses 50 when rope 5 applies axial tension on the bobbin 7. Arm 21 is connected to casing 2 by adjustment bolts 22, whose heads are located in recesses in casing 2 as shown. Tightening bolts 22 draws the arm 21 downwards and increases the tension in rope 5.

Hydraulic fluid is fed to and from rams 4 via pipe 15 and control valve l6 which connects the cylinders of the rams to either high pressure fluid via pipe 17 or to a low pressure dump tank via pipe 18. Rams 4 are of conventional single acting design and operation.

The elastic ropes 5 are composed mainly of natural cis-polyisoprene and terminate at each end in bobbin units 7. As shown in FIG. 5, the bobbin units 7 comprise a sleeve 51 which is a crimped fit upon the ends of the strands 52 of rubber from which the rope 5 is made. Typically the sleeve 51 reduces the cross-sectional diameter of the strands 52 by about 35% of their initial diameter as manufactured in the braiding process described above by being crimped onto the strands 52 to form a reduced diameter portion 53. The free ends 54 of the strands 52 are treated with a cyanoacrylate resin adhesive to improve the bonding of the strands 52 to an epoxy resin cement and are then imbedded in an epoxy resin cement carried by an end cap or plate 55. As shown in FIG. 5, the epoxy resin cement cures to form a bulb 56 on the end of the rope 5 bonding the ends of the rubber strands 52 to the end plate 55 and the end of sleeve 51. If desired, plate 55 can be in the form of a cap member shaped similarly to the exterior of the cured cement bulb 56 shown in FIG. 5 and a push or crimped fit on the free end of the sleeve 51. The sleeve 51 grips the strands 52 in a frictional grip and absorbs much of the tension applied to the bobbin unit 7 by rope 5 so that the stresses on the adhesive bond between the strands 52 and cap 55 are reduced.

As the rams 4 expand, the elastic ropes 5 are strained in extension, applying a tension force between the weight 1 and the casing 2 biassing the weight towards the chisel 3. When weight 1 has been raised to the desired extent away from chisel 3, the feed of high pressure fluid to the rams 4 is disconnected and the cylinders of the rams are connected to discharge hydraulic fluid to a dump tank and thus allow the rams to contract. The biassing force exerted by the ropes 5 accelerates the weight 1 towards the chisel 3.

Generally the point of the chisel 3 is supported on a solid surface which it is intended to penetrate or fracture. Impact of the weight 1 at its normal impact or rest position 8 (shown dotted in FIG. 1) on the chisel 3 applies a large impulsive force to chisel 3 which causes the tip of the chisel 3 to penetrate or displace the solid surface a short distance. In this short distance of movement of the chisel 3 the weight 1 is brought to rest. However, in the event that the solid surface provides less resistance than expected or the tip of the chisel is not located against the solid surface, the weight would not be brought to rest by the resistance of the solid surface and would over-run its normal extent of travel. Buffers 9 are provided below the normal extent of travel of the weight 1 within the casing 2 which absorb the kinetic energy of the weight and bring it to a stop at a point 10 within the casing in the event of such an over-run condition existing.

A resilient block 11 may be carried by the weight or the casing 2 as shown in FIG. 1 to cushion any over-run on the raising of the weight. Alternatively, as shown in FIG. 3, the block 11 can be carried off the line of travel of the weight 1 and similarly buffer 9 can act on a side stop arm 12 rather than on the weight itself.

In the present example two rams 4 are shown, symmetrically disposed about the axis of the implement, but it will be understood that the invention is not limited to two rams 4 nor to symmetrical disposition. Thus, as shown in FIG. 3, one ram may be used and this can be mounted to act off the line of travel of the weight and any twisting effect this may have is counteracted by the disposition of the wheels 30 and guide tracks 31. Furthermore, the rams 4 may be connected to the base of weight 1 and contract to raise the weight.

As stated above, the casing is provided with means for mounting the apparatus on an excavator. Thus, as shown in FIG. 7, the casing can have a lateral bracket 70 which is attached to the free end of the dipper arm of the excavator. The casing is thus mounted alongside rather than co-axially upon the dipper arm, allowing the casing to be positioned as required by articulating the dipper arm without the casing impeding the freedom of movement of the dipper arm. The dipper arm will typically comprise two sections 71 and 72 pivotally connected and provided with a ram 73 whereby the dipper arm can be articulated about the pivot connection 74. Section 72 of the dipper arm is connected to bracket 70 by a pivotal connection 75 and with an hydraulic ram 76 whereby the orientation of casing 2 and hence the position and line of action of the chisel tool can be varied.

As shown in FIG. 1, magnets 13 and 14 are shown fixed to the yoke 6 carrying the weight 1. The mountings of the magnets preferably incorporate adjustment means, not shown, which enable the magnets to be positioned at different axial positions with respect to the weight 1. A magnetic detector 13*a*, for example a reed switch or a Hall effect sensor, is mounted alongside the line of travel of weight 1 and detects the upward passage of magnet 13. Detector 13*a* gives a signal output to the hydraulic fluid control system, for example that shown in FIG. 6, to disconnect the feed of hydraulic fluid to the cylinders of the rams 4 when the weight 1 approaches the end of its upward stroke. A second magnetic detector 14*a* is mounted alongside the line of travel of weight 1 and detects the passage of magnet 14 on the downward travel of the weight 1. Detector 14*a* generates a signal to connect the cylinders of the rams 4 to the supply of high pressure hydraulic fluid to initiate the lifting stroke of the rams when weight 1 is about to strike the chisel 3. A further magnetic detector 13*b* can be located at a lower level to detector 13*a* so as to detect when the weight 1 enters the over-run zone of its travel and to disconnect the feed of high pressure fluid to the ram cylinders initiated by detector 14. The relative positions of the magnets and detectors can be selected according to the requirements of any given case using simple trial and error.

Preferably, detector 14*a* also triggers a timing sequence, for example by way of the timer module 27 in the control box 19 in FIG. 5, which timing sequence would terminate in disconnection of the hydraulic feed to the rams should the weight 1 not first reach the position to actuate detector 13*a*.

Figure 6:
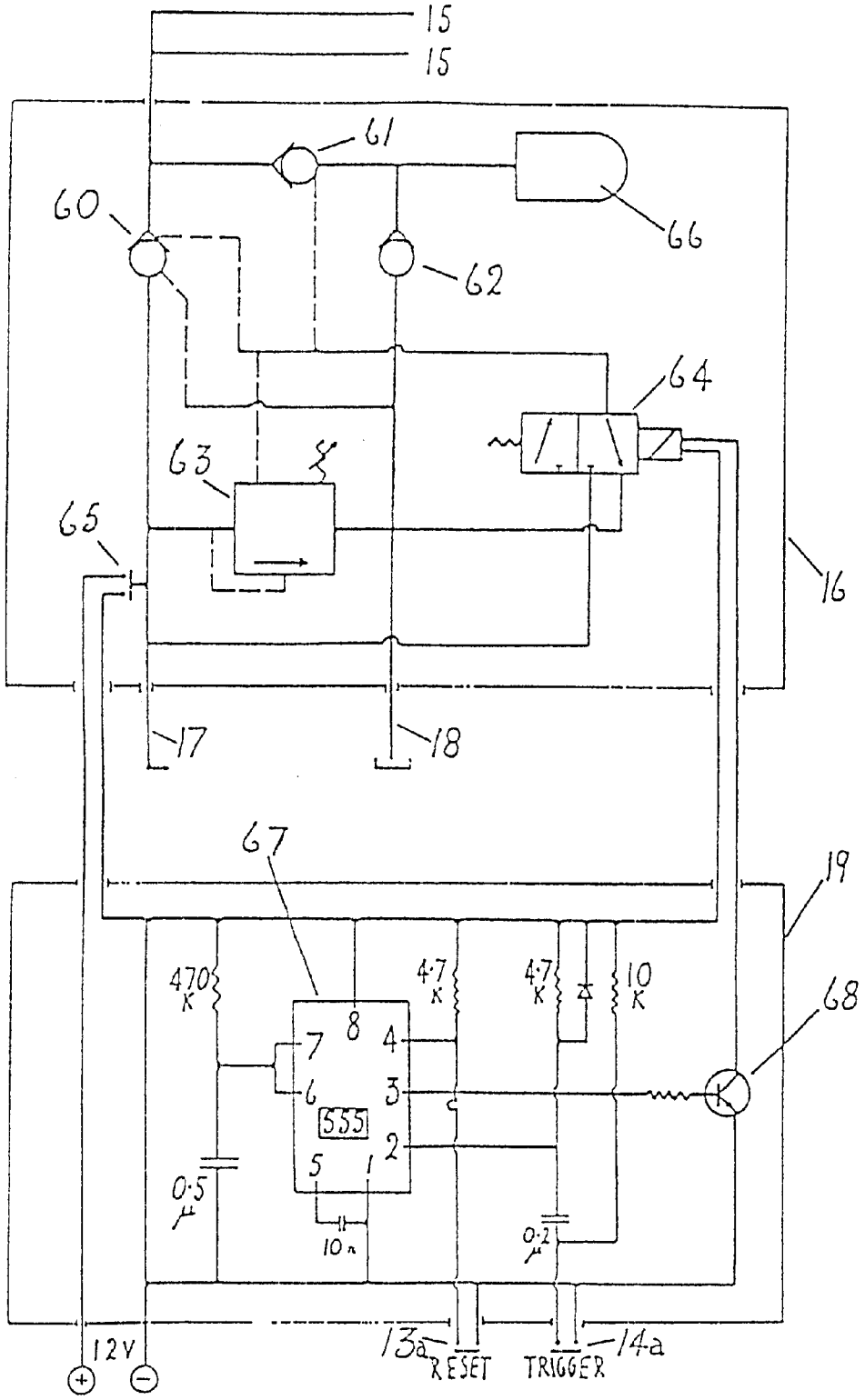
FIG. 6 shows the hydraulic and electric controls and interconnections incorporated in the apparatus of FIG. 1.
Figure 7:
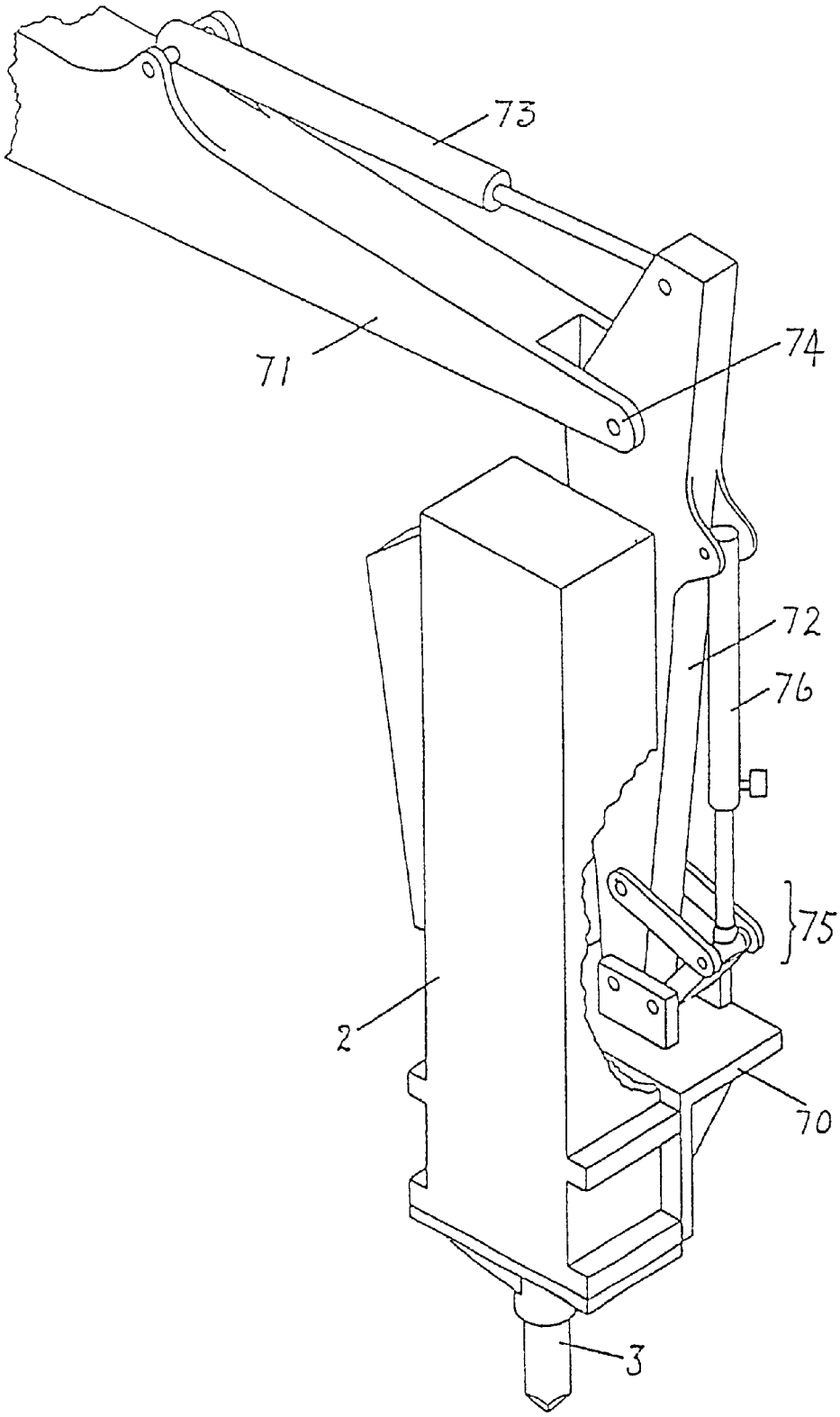
FIG. 7 is an isometric view of an arrangement for mounting the apparatus of FIG. 1 on an excavator chassis.

As shown in FIG. 6, the flow of hydraulic fluid to and from the cylinders of the rams is controlled by a valve assembly 16 under the influence of a control box 19. In the valve assembly 16, the pipes 15 from the cylinders of the rams connect with a vented pilot-to-open check valve 60 and with a pilot-to-close check valve 61. Valve 60 regulates the flow of high pressure hydraulic fluid from the pump (not shown) to the rams via pipe 17. Valve 61 is connected via a check valve 62 to the hydraulic fluid dump tank via pipe 18. The feed pipe 17 is connectable to pipe 18 by a vented pressure relief valve 63. The pilot gallery to which the pilot control connections of valves 60, 61 and 63 are made is joinable either to pipe 17 or to pipe 18 by a solenoid-controlled valve 64. A pressure switch 65 which closes on being subjected to hydraulic pressure is connected to pipe 17. A low pressure hydraulic accumulator 66 is connected to the pipe joining valves 61 and 62.

The control box 19 contains an assembly of electronic components as indicated in FIG. 6, principally a 555 timer module 67 and a transistor 68.

Referring to FIGS. 1 and 6, the system operates as follows. When hydraulic fluid under pressure is not being fed through pipe 17, the switch 65 is open, the solenoid valve 64 connects the pilot gallery to the pipe 18 and the rams 4 are connected through valves 61 and 62 to pipe 18. The pistons in rams 4 are in the lowered position and weight 1 is at rest on the head of the chisel 3, its rest position, thereby positioning magnet 14 adjacent detector 14*a* which then sends a signal to the control box 19 to close a trigger switch to energise the control circuit. Switch 65 is actuated by the pressure in pipe 17, initially causing the transistor 68 to conduct and actuate the solenoid in valve 64. Valve 61 closes, valve 60 opens and valve 63 conducts hydraulic fluid to maintain a set maximum pressure in pipe 17. The fluid under pressure in pipe 17 passes through valve 60 into feed pipes 15 to the rams 4. This causes the rams to raise weight 1.

When the magnet 13 reaches detector 13*a* as the weight rises, detector 13*a* generates a signal, resetting the 555 timer module 67 in control box 19, thereby de-energizing the solenoid in valve 64. This closes valve 60 and opens valves 61 and 63 cutting off the feed of high pressure fluid to the rams and connecting the rams to pipe 18, allowing weight 1 to fall. The tension in the elastic ropes 5 accelerates the weight 1 towards the chisel 3 and expels hydraulic fluid from the rams 4 through the pipes 15 and valve 61.

At the same time hydraulic fluid from pipe 17 is passing through valve 63 to pipe 18. On many excavators the pipe 18 will pass hydraulic fluid to the fluid supply tank feeding the pressurising pump (not shown) through a filter, and the back pressure from the filter will be present at the outlet of the check valve 62. If this back pressure is greater than the pressure in the low pressure accumulator 66, check valve 62 closes, diverting the flow from the rams 4 into the low pressure accumulator 66.

In the next half cycle when the valves 61 and 63 are closed, the low pressure accumulator 66 is able to discharge its fluid contents through the pipe 18.

Should pressure in the pipe 17 acting in the rams 4 be inadequate to stretch the elastic ropes 5 sufficiently for magnet 13 to reach detector 13*a*, the timer module 67 will complete its pre-set timing period and de-energize the solenoid in valve 64.

When the weight 1 reaches its point of impact with the chisel 3, the magnet 14 reaches the detector 14*a*, which triggers the timer module 67. Through transistor 68, this re-energizes the solenoid in valve 64. Valves 61 and 63 close, valve 60 opens, high pressure hydraulic fluid flows to pipe 15 and the rams and the weight 1 is again raised away from the chisel 3.

The above cycle repeats as long as the flow of hydraulic fluid in pipe 17 remains connected, the electrical supply to the control box 19 is maintained and the chisel does not blank strike.

The time delay initiated by detector 14*a* may be controlled by the operator, for example by means of a variable resistor which controls the reference voltage on pin 5 of the timer device 27. By shortening the time delay the operator can reduce the lift of the weight 1 by the rams 4, so obtaining an increased frequency of blows each at a reduced energy. This facility enables the operator to match the impact blow delivered by the weight to the conditions of the concrete, rock or soil upon which the chisel is acting.

In the case of a weight 1 of mass 65 kg which is to be accelerated to a velocity at impact of 5 m per sec, suitable material from which the two elastic ropes 5 may be made is of 26 mm diameter as defined in British Standard (Aerospace Series) Specification No 3F70: 1991. The ropes are made from strands mainly composed of vulcanised natural cis-polyisoprene in a condition of partial strain crystallization. When extended 75% beyond its initial length by the braiding process described above, the tension in each rope 5 is between 1600 N and 2100 N. Consequently, while the weight 1 in the example being considered is being accelerated towards the chisel 3 the recoil force on the casing 2 is equal to the tension in the elastic ropes, approximately 4 kN. The recoil force transmitted to the dipper arm of the excavator is less than this by the weight of the casing 2, ie. a net force on the dipper arm of approximately 2.5 kN (250 kgf). It may be noted that because the mass of the weight 1 is significantly greater than that of a piston which would be accelerated to the same kinetic energy in a typical conventional breaker, the extra mass of the weight serves to reduce recoil from the means of acceleration other than gravity.

Because of its low recoil force and its ability to operate with a small feed pump, a breaker according to the present invention having a given energy per impact can be mounted on a smaller excavator than has previously been possible. This factor considerably reduces running costs and enables work to be carried out where access is too limited for large machines.

Figure 8:
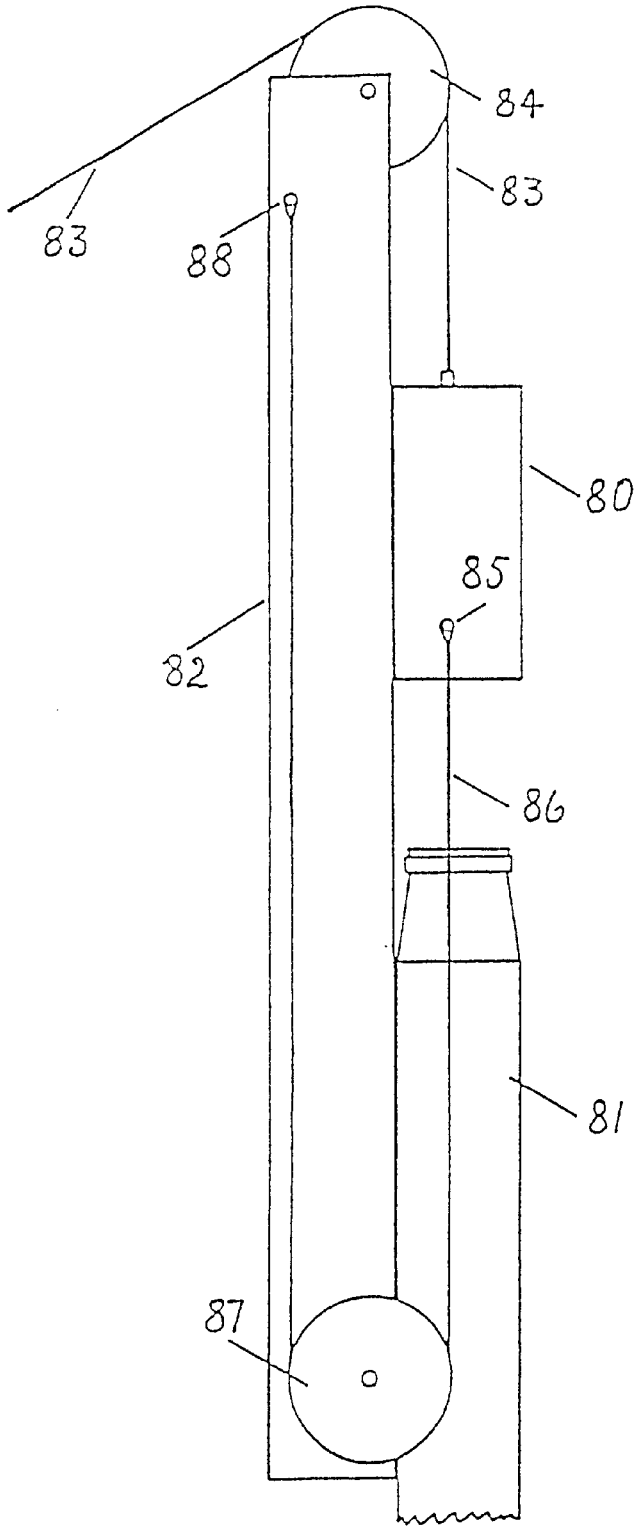
FIG. 8 is a side elevation of an implement for driving piles incorporating the invention.

FIG. 8 illustrates an alternative use of the invention in an implement in which the stroke of the travel of the weight 1 is long and variable, for example a pile driver. The weight 80 impacts on the top of a pile 81 after accelerating down a guide structure 82, which can be similar to that shown in FIGS. 3 and 4. The weight 80 is raised by a cable 83 passing over a pulley 84 journalled at the top of the structure 82, the cable being attached to a haulage means (not shown), for example an hydraulic ram. When the weight 80 nears the top of the structure 82, the haulage means is de-energized leaving the weight 80 free to fall and impact upon pile 81. As the pile 81 is driven into the ground, the distance travelled by the weight 80 increases.

Anchorage points 85 are provided on each side of the weight 80, one being visible in FIG. 8. An elastic rope 86 composed mainly of natural cis-polyisoprene as described above is secured to each of anchorage points 85 and passes downwards to attachment popints on the side of the weight 81. Where the pile does not move significantly into the ground, the elastic rope can run around a pulley 87 located adjacent the foot of structure 82 and then upwards to an anchorage point 88 adjacent the top of structure 82. If desired a number of such elastic ropes 86 may be used. The length of each elastic rope 86 is less than the distance from the anchorage points on the weight and the anchorage points 85; or in the case of the assembly shown in FIG. 8, from the upper anchorage point 88, via pulley 87, to anchorage point 85 with the weight 80 positioned at its lowest level on the structure 82. The tension in the elastic ropes 86 adds to the force of gravity when the weight 80 is accelerating towards impact with the pile 81.

Comparative trials between conventional concrete breakers and a breaker using the elastic rope biassing of the invention have demonstrated that, for a given size of excavator, breaking performance is better if blows of greater energy are delivered at lower frequency. It was also shown that, for a given kinetic energy, the greater momentum of a heavy weight is more destructive of the target than the lower momentum of a piston as used to provide the driving mass in a conventional breaker. A further advantage of the apparatus of the invention is that it can be constructed to lower standards of precision using less specialized machine tools than a conventional breaker where the driving mass is provided by the piston of the hydraulic ram, which of necessity has to be accurately constructed.

The invention has been described above in terms of the elastic rope providing the biassing force to return the weight to its rest position. However, it is within the scope of the invention to use the hydraulic ram to drive the weight towards the rest position and to use the elastic rope to return the weight to its raised position. However, this configuration is less preferred since the tension in the elastic ropes will be opposing the action of the hydraulic ram on the impact stroke and will thus reduce the impact force which can be achieved by the ram.

What is claimed is:

1. An elastic rope comprising:

(a) a plurality of strands of a synthetic elastic polymeric material, each strand having a free end disposed at an end region of the rope;

(b) a sheath enclosing substantially an entire length of the rope and holding the rope in radial compression to an extended length; and (c) means for securing the rope to an article, wherein the securing means is disposed at the end region of the rope and comprises:

(i) an end member secured to the ends of the strands by a bonding material, wherein the bonding material penetrates into interstices between the strands; and (ii) a sleeve member enclosing the rope proximate to the end region and cooperating with the end member to radially compress the rope, and adapted to reduce tension applied to the end member.

2. The elastic rope according to claim 1, wherein the elastic polymeric material is one which undergoes strain crystallisation.

3. The elastic rope according to claim 1, wherein the bonding material comprises an epoxy resin.

4. The elastic rope according to claim 3 comprising a cyanoacrylate adhesive bonded with the epoxy resin.

5. The elastic rope according to claim 1, wherein the sleeve member compresses said strands to from 55 to 80% of their initial diameter.

6. The elastic rope according to claim 1, wherein the rope is extended axially by the sheath from approximately 25 to approximately 150% beyond an untensioned length of the rope.

* * * * *